US006300922B1

(12) United States Patent
Teggatz

(10) Patent No.: US 6,300,922 B1
(45) Date of Patent: Oct. 9, 2001

(54) DRIVER SYSTEM AND METHOD FOR A FIELD EMISSION DEVICE

(75) Inventor: Ross E. Teggatz, McKinney, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 09/224,978

(22) Filed: Jan. 4, 1999

Related U.S. Application Data

(60) Provisional application No. 60/070,609, filed on Jan. 5, 1998.

(51) Int. Cl.[7] ..... G09G 3/22

(52) U.S. Cl. ..... 345/75.2; 345/84; 345/148

(58) Field of Search ..... 345/74.1, 147, 345/75.2, 84, 55, 67, 60; 315/169.1, 148

(56) References Cited

U.S. PATENT DOCUMENTS 5,436,634 * 7/1995 Kanazawa ..... 345/67
5,689,278 * 11/1997 Barker et al. ..... 345/74
5,748,159 * 5/1998 Nishio et al. ..... 346/76
5,754,148 * 5/1998 Kishino et al. ..... 345/74
5,777,589 * 7/1998 Gale et al. ..... 345/84
5,874,932 * 2/1999 Nagaoka et al. ..... 345/60
5,939,833 * 8/1999 Song et al. ..... 315/169.1
5,986,640 * 11/1999 Baldwin et al. ..... 345/147

* cited by examiner

*Primary Examiner*—Steven Saras
*Assistant Examiner*—Srilakshmi Kumar

(57) ABSTRACT

A field emission device (10) for reducing the power dissipation of an array (14) includes video controller (12) coupled to array (14) by memory (13), column drivers (16), row drivers (20), and anode power supply (22). Column drivers (16) includes PWM circuit (17) coupled to signal conditioner (18). Signal conditioner (18) receives input digital signal (24) from PWM circuit (17) and generates output digital signal (26) that reduces the frequency of state transitions of signal (24) while maintaining the same duty cycle as that of signal (24). This reduces the power dissipation of parasitic capacitances (36) associated with array (14) pursuant to the equation $P=\frac{1}{2}CV^2f$.

20 Claims, 2 Drawing Sheets

DRIVER SYSTEM AND METHOD FOR A FIELD EMISSION DEVICE

This application claims priority under 35 USC §119(e)(1) of provisional application Ser. No. 60/070,609 filed Jan. 5, 1998.

TECHNICAL FIELD OF THE INVENTION

This invention relates in general to the field of electronic devices and, more particularly to a driver system and method of operation for a field emission device.

BACKGROUND OF THE INVENTION

A field emission device (FED) comprises a cathode which may be conically shaped or have some other suitable form to provide for a point from which electrons are emitted upon application of an electric field. An anode is placed near the tip of the cathode, but separated from the cathode by a vacuum. A FED array includes field emission devices arranged in a series of columns and rows. Each column and row interface defines a pixel having an associated parasitic capacitance. Current display applications demand thinner, lighter, brighter, and less expensive FED arrays that consume less power.

To activate a pixel, a row driver supplies a voltage to each gate in a row of the FED array. A column driver supplies a voltage signal to each cathode in a column of the FED array. This forms an electric field between each cathode and gate at the pixel of the designated column and row. The magnitude of this electric field across the cathode and gate of each pixel controls the emission of electrons from each cathode of a given pixel. An anode power supply provides a global voltage to each pixel in the FED array, creating another electric field between the anode and the cathode of each pixel. The magnitude of this electric field controls the intensity of the light emitted at each pixel.

Typically, a column driver supplies a pulse-width modulated voltage signal starting at a low state and transitioning to a high state later in the frame of the signal, depending on the brightness desired at each pixel. At the beginning of the next frame of the signal, the signal is returned to a low state. Each state transition from high to low discharges the parasitic capacitance associated with each pixel of the FED array. Thereafter, each state transition from low to high recharges these capacitances. Discharging and recharging the capacitances of the FED array causes undesired power dissipation proportional to the frequency of the column driver output signal, pursuant to the equation $P=\frac{1}{2}CV^2f$.

One effort to minimize the power dissipation of FED arrays employs energy recovery circuits. Another technique supplies an analog voltage signal to each column of the array. However, both of these methods require additional components and complexity. These additional components are expensive and occupy valuable packaging space. The resulting FED array is larger and consumes more power than desired or feasible.

SUMMARY OF THE INVENTION

In accordance with the present invention, a field emission device driver system is provided which substantially eliminates or reduces disadvantages and problems associated with prior driver systems.

In accordance with one embodiment of the present invention, a system for reducing the power dissipation of a load includes a driver circuit coupled to a signal conditioner that receives an input signal and generates an output signal having a series of frames. Each frame comprises a selected one of a corresponding frame of the input signal in forward order and a corresponding frame of the input signal in reverse order, in response to the state of a last time segment of a preceding frame of the output signal.

Another embodiment of the present invention is a method for reducing the power dissipation of a load that includes receiving an input signal and generating an output signal having a series of frames. Each frame comprises a selected one of a corresponding frame of the input signal in forward order and a corresponding frame of the input signal in reverse order, in response to the state of a last time segment of a preceding frame of the output signal.

Technical advantages of the present invention include a driver system that reduces the power dissipation of a capacitively loaded device. In a particular application, a FED array receives via column drivers an input signal that specifies a level of illumination for each pixel in a column. A signal conditioner reduces the frequency of state transitions between frames of the input signal while maintaining the proper duty cycle of each frame of the signal. Due to the reduced number of transitions between frames, parasitic capacitances associated with the display discharge and recharge fewer times as under previous FED driver systems, thereby reducing the power dissipation associated with the FED display.

BRIEF DESCRIPTION OF THE DRAWINGS

For a more complete understanding of the present invention and its advantages, reference is now made to the following description taken in conjunction with the accompanying drawings, in which like reference numbers indicate like features and wherein.

DETAILED DESCRIPTION OF INVENTION

Figure 1:
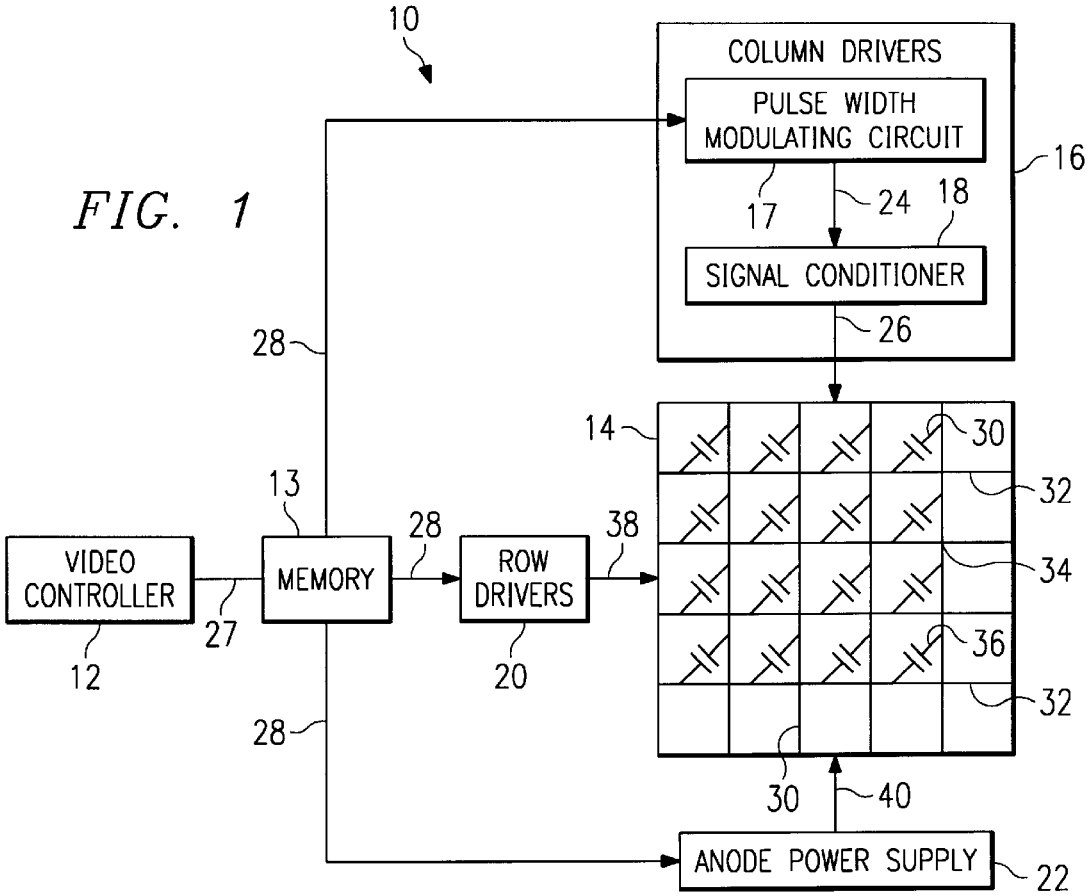
FIG. 1 is a block diagram of a field emission device in accordance with the teachings of the present invention.

FIG. 1 is a block diagram of a field emission device (FED) 10 that includes an array 14 of pixels 34 to display information generated by a video controller 12. Controller 12 couples to column drivers 16, row drivers 20, and an anode power supply 22 via a memory 13. Column drivers 16 includes a pulse-width modulating (PWM) circuit 17 coupled to a signal conditioner 18. In general, signal conditioner 18 receives an input digital signal 24 from PWM circuit 17 and generates an output digital signal 26 for array 14 that reduces the power dissipation of device 10. Although the following description of the present invention focuses upon field emission devices, it should be understood that the present invention also reduces the power dissipation of other capacitively loaded devices, such as electroluminescent displays, plasma displays, or other suitable flat panel displays.

Video controller 12 may comprise a processor that generates video data 27 to control the operation of FED 10. Memory 13 may comprise a file, stack, or other suitable organization of memory that receives video data 27 from video controller 12 and stores this information. Memory 13 synchronizes video data 27 according to a master clocking signal and transfers video data 27 as video digital signal 28 to array 14 through column drivers 16, row drivers 20 and anode power supply 22. Video digital signal 28 controls the operation of array 14, and specifically the intensity of illumination of each pixel 34 in array 14.

Array 14 includes a matrix of pixels 34 arranged in a series of columns 30 and rows 32. Each column and row interface defines a particular pixel 34 having an associated parasitic capacitance 36 that dissipates power during operation. It should be understood that FIG. 1 depicts four columns 30 and four rows 32 for illustrative purposes only, and that fewer or greater columns 30 and rows 32 may be included in display 14. Furthermore, although capacitances 36 are not visible in display 14, they are depicted in FIG. 1 for illustrative purposes.

Each column driver 16 includes PWM circuit 17 that receives video digital signal 28 in a serial fashion and generates an input digital signal 24 for each column 30 of array 14 in a parallel fashion. Each signal 24 includes a series of frames associated with the master clocking signal to drive a corresponding series of pixels 34 in a particular column 30. Each frame comprises n time segments associated with a desired resolution wherein each time segment provides a voltage to a corresponding single pixel 34 in response to video digital signal 28.

For example, a single frame for a specified pixel 34 may include eight time segments, with each time segment corresponding to a low state (e.g., logic "0"), or a high state (e.g., logic "1"). Assume logic "0" corresponds to an on or activated pixel 34 and logic "1" corresponds to an off or deactivated pixel 34. Using pulse width modulation, column drivers 16 can generate a frame to specify a relatively bright pixel 34, (e.g., 00000011), a frame to specify a relatively dim pixel 34, (e.g., 00111111), or any other arrangement of high and low states.

Although the following description of FED 10 focuses upon signals 24 and 26 whose time segments have a low state and a high state, it should be understood that the present invention also applies to signals whose time segments have multiple state levels, such as a low state, an intermediate low state, an intermediate high state, and a high state, or any other suitable set of state levels. Accordingly, the present invention may operate to eliminate state transitions between adjacent frames of a signal whose time segments have multiple state levels or it may reduce the magnitude of the state transition between adjacent frames to reduce the power dissipation of device 10.

Signal conditioner 18 includes a suitable configuration of logic elements that receives input digital signal 24 for each particular column 30 in display 14 and generates a corresponding output digital signal 26 that eliminates state transitions between successive frames to reduce power dissipation in device 10. Specifically, signal conditioner 18 re-orders the "1"s and "0"s in each frame to ensure no state transition from the previous frame. This technique limits the total number of state transitions per frame to one.

Row drivers 20 may comprise a voltage source that supplies a voltage signal 38 to each row 32 of array 14, in response to video digital signal 28. Anode power supply 22 may comprise a voltage source that supplies a common voltage signal 40 to the anode of all pixels 34 of array 14 in response to video digital signal 28.

In operation, row drivers 20 supply voltage signal 38 to each row 32 of array 14, in succession, in a process conventionally known as "rastering." PWM circuit 17 generates input digital signal 24 for each column 30 of display 14. Signal conditioner 18 receives for each column 30 a signal 24 having a transition from a high state to a low state at each interface between frames followed by a later transition from a low state to a high state within each frame. Driving columns 30 with signal 24, as in prior FED devices, causes parasitic capacitances 36 to dissipate power by discharging and recharging for each state transition of input signal 24.

Alternatively, signal conditioner 18 generates an output digital signal 26 to drive columns 30 that eliminates state transitions between frames while maintaining the same duty cycle as the corresponding frame of signal 24. Supplying signal 26 to columns 30 reduces the frequency with which parasitic capacitances 36 discharge and recharge during operation of device 10. This reduces the power dissipation of parasitic capacitances 36 pursuant to the equation $P=\frac{1}{2}CV^2f$, where "C" is the capacitance of each column 30, "V" is the difference in magnitude of the high state supply voltage and the low state supply voltage associated with signal 26, and "f" is the time required for signal 26 to transition from a low state to a high state and back to a low state. In one embodiment, supplying signal 26 to columns 30 reduces in half the frequency with which capacitances 36 charge and discharge. Accordingly, the power dissipation of these capacitances 36 also reduces in half.

Figure 2:
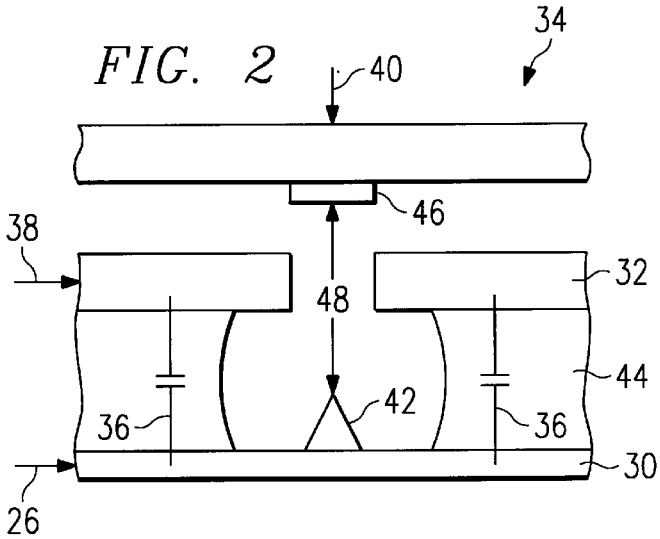
FIG. 2 illustrates, in more detail, a pixel of the field emission device.

FIG. 2 illustrates, in more detail, a pixel 34 of array 14 of device 10. Pixel 34 includes a cathode 42 coupled to a column 30 of array 14, and a row 32 coupled to column 30 at interface 44. Each pixel 34 has parasitic capacitances 36 across each interface 44 between columns 30 and rows 32. Each pixel 34 includes an anode 46 arranged in parallel to cathode 42. Anode 46 may comprise phosphorous, plasma, or any other suitable electroluminescent material. A predetermined distance or gap 48 separates anode 46 and cathode 42. The volume defined by gap 48 and the sealed peripheral edges of array 14 (not explicitly shown) preferably maintains a negative pressure or vacuum. Electrons emitted by cathode 42 traverse gap 48 and impinge on anode 46, causing anode 46 to luminesce or glow with a predetermined pattern.

In operation, output digital signal 26 supplies one frame of voltage to cathode 42 of each successive pixel 34 in a particular column 30. Row drivers 20 supply a voltage signal 38 to each successive row 32 of array 14. In one embodiment, row drivers 20 supply a high voltage to the active row 32 while the remaining rows 32 receive no voltage and the immediately preceding row 32 is coupled to ground to reduce resident voltages and eliminate ghosting images. The voltage potential between cathode 42 and row 32 at each pixel 34 generates an electric field which causes electrons to discharge from cathode 42. Generally, the larger the voltage potential between cathode 42 and row 32, the more electrons discharge from cathode 42 and the brighter the light generated at pixel 34. The magnitude of this voltage potential depends on the duty cycle of the corresponding frame of signal 26.

Each time the state of digital signal 26 transitions from high to low to high again, capacitances 36 discharge and recharge causing undesired power dissipation in array 14. This occurs not only on the row 32 of the selected pixels 34, but for all pixels 34 in column 30. Signal conditioner 18 eliminates state transitions between frames of digital signal 26 while maintaining the proper duty cycle of each frame of signal 26 so as to provide the proper level of illumination of each pixel 34 in array 14. As a result, parasitic capacitances 36 discharge and recharge fewer times as under previous FED driver systems, thereby reducing the power dissipation associated with each array 14.

Figure 3:
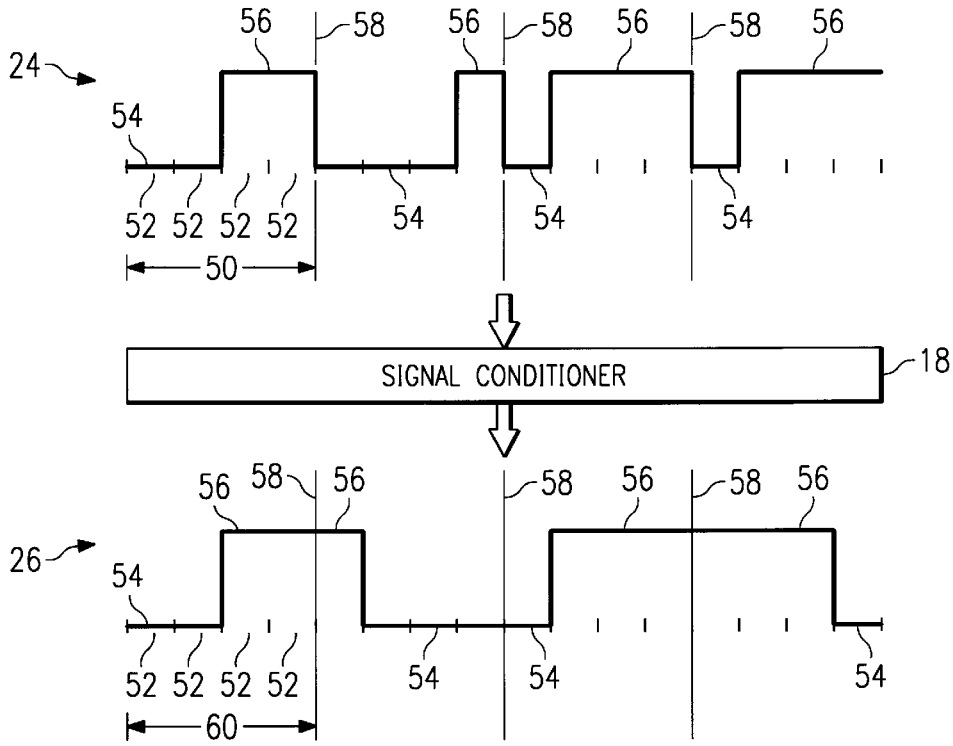
FIG. 3 illustrates an input and output digital signal of a signal conditioner of the field emission device.

FIG. 3 illustrates signals 24 and 26 of signal conditioner 18 as a function of time. Although the following description of signal conditioner 18 focuses upon the process of converting a signal 24 into a signal 26 for a particular column 30 of array 14, it should be understood that signal conditioner 18 converts a signal 24 into a signal 26 for each column 30 of array 14. A signal conditioner may similarly operate on each row 32 of array 14 to reduce the charging and discharging of capacitances 36 during operation of device 10. Each column driver 16 generates input digital signal 24 having a series of frames 50. Each frame 50 provides a voltage to a single pixel 34 in column 30, in response to video digital signal 28. Each frame 50 has n time segments 52 wherein the state of each segment 52 determines the brightness of the light emitted at the corresponding pixel 34.

A frame 50 having a majority of segments 52 at a high state 56, (e.g., 00111111), will generate a dim light because the voltage potential between cathode 42, supplied by frame 50, and row 32, set at a high potential, is small. Conversely, a frame 50 having a majority of segments 52 at a low state 54, (e.g., 00000011), will generate a bright light because the voltage potential between cathode 42 and row 32 is large. In a particular embodiment, each frame 50 of signal 24 starts at a low state 54, (e.g., "0"), for the first segment 52 and transitions to a high state 56, (e.g., "1"), at some later segment 52 in frame 50 depending on the desired level of illumination for the corresponding pixel 34, (e.g., 00111111 or 00000011).

Each series of transitions from high state 56 to low state 64 and back to high state 56 dissipates power through capacitances 36, pursuant to the equation $P=\frac{1}{2}CV^2f$. Therefore, the power dissipation of capacitances 36 is proportional to the frequency or number of state transitions in signal 24.

Signal conditioner 18 receives each frame 50 of signal 24 and generates a corresponding signal 26 having corresponding frames 60 that provide a voltage to each pixel 34. Each frame 60 also has n time segments 52, wherein the state of each segment 52 determines the level of illumination of the light emitted at the corresponding pixel 34 of column 30. Each frame 60 of signal 26 is reversed from the corresponding frame 50 of signal 24 if the last segment 52 of the previous frame 60 has a high state 56. Each frame 60 of signal 26 equals the corresponding frame 50 of signal 24 if the last segment 52 of the previous frame 60 has a low state 54.

Reversing selected frames 60 of signal 26 reduces the power dissipation of capacitances 36 by eliminating unnecessary state transitions at interface 58 between adjacent frames 52 of signal 26. In particular, eliminating state transitions at interface 58 of signal 26 reduces the frequency with which capacitances 36 charge and discharge. Consequently, the power dissipation of capacitances 36 reduces according to the equation $P=\frac{1}{2}CV^2f$. Simultaneously, signal conditioner 18 maintains the same level of illumination for each pixel 34 as signal 24 by maintaining the duty cycle of each frame 60 equal to the duty cycle of each corresponding frame 50 of signal 24.

For example, referring to FIG. 3, although signal conditioner 18 reverses the second frame 50 of signal 24 into a corresponding second frame 60, second frame 60 maintains the three segments 52 with a low state 54 as in second frame 50, and it maintains the one segment 52 with a high state 56 as in second frame 50. Similarly, fourth frame 60 maintains the one segment 52 with a low state 54 as in fourth frame 50, and it maintains the three segments 52 with a high state 56 as in fourth frame 50.

Figure 4:
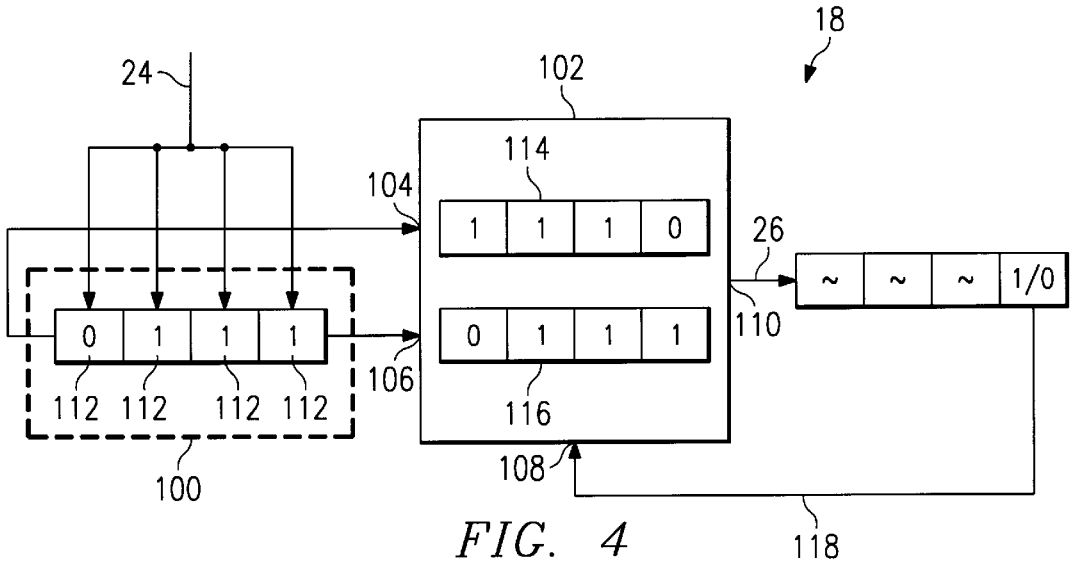
FIG. 4 illustrates one embodiment of the signal conditioner.

FIG. 4 illustrates one embodiment of signal conditioner 18 of device 10. Signal conditioner 18 includes a bidirectional register 100 coupled to a multiplexer 102 having a reverse input terminal 104, a forward input terminal 106, a toggle input terminal 108, and an output terminal 110. Bidirectional register 100 includes n time segments 112, one for each segment 52 of each frame 50.

In operation, column driver 16 loads each segment 52 of each frame 50 into the corresponding segment 112 of bidirectional register 100. For example, driver 16 loads frame 50, (e.g., 0111), into register 100. Bidirectional register 100 inputs each segment 112 in reverse order to multiplexer 102 at reverse terminal 104 as reverse input signal 114, (e.g., 1110). Register 100 inputs each segment 112 in forward order to multiplexer 102 at forward terminal 106 as forward input signal 116, (e.g., 0111). The last segment 112 of the preceding frame 60 of output digital signal 26 is provided to multiplexer 102 at toggle input terminal 108 as toggle input signal 118.

Multiplexer 102 monitors toggle input signal 118 to determine the order of the current frame 60 of signal 26. If the state of toggle input signal 118 is high, multiplexer 102 generates frame 60 of signal 26 equal to reverse input signal 114, (1110). If the state of toggle signal 118 is low, multiplexer 102 generates frame 60 of signal 26 equal to forward input signal 116, (0111). As a result, multiplexer 102 processes each frame 50 of signal 24 and generates a corresponding frame 60 of signal 26 whose first segment 112 has the same state as the last segment 112 of the immediately preceding frame 60, and whose duty cycle equals the duty cycle of the corresponding frame 50. This eliminates unnecessary state transitions at each interface 58 between frames 60, thereby reducing the frequency with which parasitic capacitances 36 charge and discharge. Consequently, the power dissipation of array 14 reduces pursuant to the equation $P=\frac{1}{2}CV^2f$.

Although the present invention has been described with several embodiments, a myriad of changes, variations, alterations, transformations, and modifications may be suggested to one skilled in the art, and it is intended that the present invention encompass such changes, variations, alterations, transformations, and modifications as fall within the spirit and scope of the appended claims.

What is claimed is:

1. A system for reducing the power dissipation of a load comprising:

a driver circuit;

a signal conditioner coupled to the driver circuit and operable to receive an input signal and generate an output signal having a series of frames, wherein each frame comprises a selected one of a corresponding frame of the input signal in forward order and a corresponding frame of the input signal in reverse order, in response to the state of a last time segment of a preceding frame of the output signal; and a capacitively loaded device coupled to the signal conditioner and operable to receive the output signal.

2. The system of claim 1, further comprising:

a memory coupled to the driver circuit; and a second driver circuit coupled to the memory.

3. The system of claim 1, wherein the driver circuit comprises a pulse width modulating circuit.

4. The system of claim 1, wherein the signal conditioner further comprises a logic unit operable to generate a frame of the output signal having a plurality of time segments, and wherein:

the state of a first time segment of the frame of the output signal comprises the state of the last time segment of the preceding frame of the output signal; and the frame of the output signal has a substantially equal amount of low state and high state time segments as a corresponding frame of the input signal.

5. The system of claim 1, wherein the signal conditioner further comprises:

a bidirectional register operable to receive the input signal; and a multiplexer coupled to the bidirectional register, the multiplexer operable to generate a frame of the output signal having a first section of one or more low state time segments and a second section of one or more high state time segments, wherein the multiplexer orders the first section and the second section in response to the state of the last time segment of the preceding frame of the output signal.

6. The system of claim 1, wherein the capacitively loaded device comprises a flat panel display.

7. The system of claim 1, wherein the capacitively loaded device comprises a field emission device array having a plurality of columns and a plurality of rows, and wherein an interface between each column and each row defines a pixel.

8. The system of claim 7, wherein the signal conditioner provides the output signal to a selected column of the field emission device array.

9. A method for reducing the power dissipation of a load, comprising:

receiving an input signal;

generating an output signal having a series of frames, wherein each frame comprises a selected one of a corresponding frame of the input signal in forward order and a corresponding frame of the input signal in reverse order, in response to the state of a last time segment of a preceding frame of the output signal; and receiving the output signal at a field emission device array.

10. The method of claim 9, further comprising generating an input signal at a pulse width modulating circuit prior to the step of receiving the input signal, wherein the input signal comprises a series of frames, and wherein each frame comprises a plurality of time segments.

11. The method of claim 9, wherein the step of generating an output signal comprises:

receiving the state of the last time segment of the preceding frame of the output signal;

generating a frame of the output signal having a first section of one or more low state time segments, and a second section of one or more high state time segments; and ordering the first section and the second section in response to the state of the last time segment of the preceding frame of the output signal.

12. The method of claim 9, wherein the step of generating an output signal comprises:

receiving the state of the last time segment of a preceding frame of the output signal; and generating a frame of the output signal wherein the state of a first time segment of the frame of the output signal comprises the state of the last time segment of the preceding frame of the output signal and the frame of the output signal has a substantially equal amount of low state and high state time segments as a corresponding frame of the input signal.

13. The method of claim 9, wherein the field emission device array comprises a plurality of columns and a plurality of rows, wherein an interface between each column and each row defines a pixel.

14. The method of claim 13, further comprising providing the output signal to a selected column of the field emission device array.

15. A system for reducing the power dissipation of a field emission device, comprising:

a memory;

a driver circuit coupled to the memory and operable to generate an input signal;

a signal conditioner coupled to the driver circuit, and operable to receive the input signal and generate an output signal having a series of frames, wherein each frame comprises a plurality of time segments, and wherein:

the state of a first time segment of each frame of the output signal comprises the state of a last time segment of a preceding frame of the output signal; and each frame of the output signal has a substantially equal amount of low state and high state time segments as a corresponding frame of the input signal; and a field emission device array coupled to the signal conditioner and operable to receive the output signal.

16. The system of claim 15, wherein the driver circuit comprises a pulse width modulating circuit.

17. The system of claim 15, wherein the signal conditioner further comprises:

a bidirectional register operable to receive a frame of the input signal; and a multiplexer coupled to the bidirectional register, the multiplexer operable to generate a corresponding frame of the output signal comprising a selected one of the corresponding frame of the input signal in forward order and the corresponding frame of the input signal in reverse order, in response to the state of the last time segment of the preceding frame of the output signal.

18. The system of claim 15, wherein the signal conditioner further comprises a logic unit operable to generate a frame of the output signal having a first section of one or more low state time segments and a second section of one or more high state time segments, wherein the logic unit orders the first section and the second section in response to the state of the last time segment of the preceding frame of the output signal.

19. The system of claim 15, wherein the field emission device array comprises a plurality of columns and a plurality of rows, and wherein an interface between each column and each row defines a pixel.

20. The system of claim 19, wherein the signal conditioner provides the output signal to a selected column of the field emission device array.

* * * * *